US011384631B2

(12) United States Patent
Santarelli

(10) Patent No.: US 11,384,631 B2
(45) Date of Patent: Jul. 12, 2022

(54) TUBING CONDITION MONITORING

(71) Applicant: Geomec Engineering Limited, London (GB)

(72) Inventor: Frederic Joseph Santarelli, Stavanger (NO)

(73) Assignee: GEOMEC ENGINEERING LTD., London (GB)

( * ) Notice: Subject to any disclaimer, the term of this patent is extended or adjusted under 35 U.S.C. 154(b) by 0 days.

(21) Appl. No.: 17/260,788

(22) PCT Filed: Jul. 15, 2019

(86) PCT No.: PCT/GB2019/051969
§ 371 (c)(1),
(2) Date: Jan. 15, 2021

(87) PCT Pub. No.: WO2020/016559
PCT Pub. Date: Jan. 23, 2020

(65) Prior Publication Data
US 2021/0324730 A1 Oct. 21, 2021

(30) Foreign Application Priority Data
Jul. 15, 2018 (GB) ..... 1811590

(51) Int. Cl.
*E21B 47/007* (2012.01)
*E21B 47/06* (2012.01)

(52) U.S. Cl.
CPC ..... *E21B 47/007* (2020.05); *E21B 47/06* (2013.01)

(58) Field of Classification Search
CPC ..... E21B 47/007; E21B 47/06
See application file for complete search history.

(56) References Cited

U.S. PATENT DOCUMENTS 6,993,963 B1 2/2006 Gudmundsson
2003/0173079 A1 9/2003 Chikiun
(Continued)

FOREIGN PATENT DOCUMENTS

GB 2539002 A * 12/2016 ..... E21B 43/26
RU 2151856 C1 6/2000

OTHER PUBLICATIONS

Examination Report from the GCC Patent Office for corresponding application No. GC 2019-37909, dated Jul. 20, 2020.
(Continued)

*Primary Examiner* — Robert E Fuller
*Assistant Examiner* — Lamia Quaim
(74) *Attorney, Agent, or Firm* — McDonnell Boehnen Hulbert & Berghoff LLP

(57) ABSTRACT

A method of condition monitoring of tubing (10) in an injection well (12). A baseline measurement of friction loss in the tubing is taken by obtaining pressure responses at the wellhead (34) and downhole for a number of injection rates. After a period of time, pressure responses at the wellhead and downhole are taken when the well is shut-in. Analysis of the Instantaneous Shut-In Pressure (ISIP) at the wellhead and downhole on shut-in provide the friction loss in the tubing for the last injection rate before shut-in. A comparison can be made with the baseline measurement of friction loss to indicate deterioration of the inner surface of the tubing if the friction loss has increased. The baseline measurement may be made using a step rate test or by analysis of the combined ISIP.

13 Claims, 4 Drawing Sheets

(56) References Cited

U.S. PATENT DOCUMENTS

| | | | |
|---|---|---|---|
| 2004/0253734 | A1 | 12/2004 | Firmin |
| 2007/0277975 | A1 | 12/2007 | Lovell et al. |
| 2011/0301851 | A1 | 12/2011 | Briers et al. |
| 2012/0155508 | A1 | 6/2012 | Dria |

OTHER PUBLICATIONS

Search Report from the GB Intellectual Property Office for corresponding application No. GB1811590.7, dated Dec. 3, 2018.
International Preliminary Examination Report from the ISA for PCT/GB2019/051969, dated Jan. 19, 2021.

* cited by examiner

TUBING CONDITION MONITORING

CROSS REFERENCE TO RELATED APPLICATION

This application is a U.S. national phase of International Application No. PCT/GB2019/051969, filed Jul. 15, 2019, which claims priority to United Kingdom Patent Application No. 1811590.7, filed Jul. 15, 2018, both of which are incorporated by reference herein in their entirety.

The present invention relates to condition monitoring in tubing in a well bore and more particularly, though not exclusively, to an interventionless method of condition monitoring of tubing in a water injection well.

In a typical well, a borehole is drilled which is then cased. The casing is tubing or pipe which is inserted in progressively smaller diameter sections to line the borehole and prevent collapse. Cement is placed in the annulus outside the casing to improve its strength. Further tubing, referred to as liner, can be hung from casing to increase the depth of the well. The tubing will be perforated in the intended production zone and a smaller diameter tubing, production tubing, is run from the production zone back to the wellhead. The production of fluids such as oil, gas and water, can be recovered through the production tubing. Also fluids can be injected through the smaller diameter tubing into the zone. Commonly referred to as injection wells, fluids such as water, wastewater, brine, chemicals and CO2, are injected into porous rock formations underground. Injection wells have a range of uses including enhancing oil production, long term (CO2) storage, waste disposal, mining, and preventing salt water intrusion.

Well tubing is subject to extreme conditions of temperature, pressure and chemical exposure. As a result, the inner surface of the tubing may be subject to corrosion and chemical or mechanical abrasion, creating roughening, pitting and loss of material. Deposits and scaling can also adhere to the inner surface. This deterioration or wear of the smooth inner surface of the metal tubing will also affect any injection programme as it will reduce the bottom hole pressure (BHP) at the perforations. For injection, BHP equals the pump pressure plus the hydrostatic pressure minus friction losses.

The hydrostatic pressure is the pressure at depth created by the volume of fluid in the tubing. It is zero at surface and increases linearly with depth. Friction loss in the tubing is dependent on flow rate, diameter of the tubing and a roughness coefficient of the tubing. The roughness coefficient changes with wear. Friction loss increases non-linearly with injection rate. Consequently, tubing wear and its effect on friction losses needs to be correctly accounted for as, for example in a frac injection programme, too high an estimate will result in injection at below the frac pressure and failure to increase the fracture network, whereas too low an estimate may result in frac pressures in excess of regulatory guidelines and risk providing a fracture network extending to an aquifer.

The current techniques to monitor wear in tubing rely on monitoring pressure in the annulus between concentric tubing to detect for leaks and to perform periodical inspections. Inspection is achieved by running a logging tool into the well bore. These tools are run on wireline or slickline. The tool contains various instruments designed to measure dimensions of the tubing such as the inner diameter ('caliper') and wall thickness along the length of the tubing. However, such inspections require intervention and the well must be put out of operation for a period of time.

It is therefore an object of the present invention to provide a method of condition monitoring of tubing in an injection well which obviates at least some of the disadvantages of the prior art.

According to a first aspect of the present invention there is provided a method of condition monitoring of tubing in an injection well, comprising the steps:

(a) measuring a first bottom hole pressure response downhole at a bottom hole location in the well and a first wellhead pressure response at a wellhead of the well for a plurality of base injection rates of fluid in the well;

(b) determining a friction loss in the tubing between the bottom hole location and the wellhead from the first wellhead pressure response and the first bottom hole pressure response at each of the base injection rates to provide a baseline measurement of friction loss in the tubing against the base injection rates;

(c) after a first time period;

(d) measuring a second bottom hole pressure response and a second wellhead pressure response for a monitored injection rate of fluid in the well;

(e) determining a friction loss in the tubing between the bottom hole location and the wellhead from the second wellhead pressure response and the second bottom hole pressure response at the monitored injection rate to provide a monitored measurement of friction loss in the tubing at the monitored injection rate;

(f) analysing the monitored measurement by making a comparison with the baseline measurement to determine any change in friction loss over the first time period;

(g) using an increase in friction loss over the first time period as an indicator of deterioration in the condition of the tubing; and the method being characterised in that:

the second bottom hole pressure response and the second wellhead pressure response are measured at a shut-in of the well.

In this way, the friction loss in the tubing can be automatically calculated at each shut-in and the condition of the tubing monitored during the life of the injection well. As the process can use measurements from gauges already present in the well, the process requires no intervention. Additionally, as an injection well is routinely shut-in, there is no cost associated with condition monitoring in either stoppage time or monitoring equipment.

Preferably, steps (d) to (g) are repeated for at least two shut-ins. More preferably, steps (d) to (g) are repeated for every shut-in. The time period may therefore be considered as the time between consecutive shut-ins. In this way, a graph of friction loss in the tubing against injection rate can be constructed to monitor change in friction loss and consequential deterioration of the tubing.

Preferably, the monitored injection rate is determined from a last injection rate before shut-in. As the injection rate is always known at shut-in there is no requirement for additional equipment to measure this value.

In an embodiment, the baseline measurement of friction loss is determined over a range of injection rates by performing steps (a) and (b) as part of a step rate test. In this way, a characteristic friction loss curve can be obtained as the baseline measurement for better later comparison at any injection rate.

Preferably, measurement of friction loss in steps (d) and (e) is part of an Instantaneous Shut-In Pressure (ISIP) analysis. More preferably, the ISIP is analysed for the second bottom hole pressure response and the second wellhead pressure response.

In an embodiment the baseline measurement of friction loss is determined over a range of injection rates by performing steps (a) and (b) as a series of shut-ins and analysing the ISIP.

Preferably, the baseline measurement of friction loss is performed with newly installed tubing. In this way, condition monitoring of the tubing can be made over the life of the tubing.

The shut-ins may be voluntary or accidental. In this way, data collected continuously by wellhead and bottom hole pressure gauges can be analysed at each shut-in to perform the method.

Preferably the calculation of friction loss using the bottom hole pressure response and the wellhead pressure response is corrected for hydrostatic pressure at each depth in the well.

The method may include the additional steps of running a tubing log in the event that a deterioration in the condition of the tubing is determined. The tubing log may be a multi-arm caliper or the like. The method may include the further additional steps of replacing the tubing.

The method may include determining fluid injection parameters for the injection well from the change in monitored friction loss of the tubing. In this way, fluid injection can be optimised for the well.

Preferably the bottom hole pressure responses and the wellhead pressure responses are collected at a sampling rate of at least one measurement per 10 seconds. More preferably the bottom hole pressure responses and the wellhead pressure responses are collected at a sampling rate of at least one measurement per second. In this way the sampling rate frequency of measurement can match the type of shut-in i.e. rate frequency can be lower for a hard shut-in.

Preferably, the bottom hole pressure responses and the wellhead pressure responses are collected at the same point in time by clock synchronisation of the bottom hole pressure gauge and the wellhead pressure gauge. This improves the quality of the comparison for the calculation of friction loss.

Preferably, the injection rate is measured with a flow rate meter at the wellhead. Preferably, the injection rate is sampled at a rate of at least one measurement every 30 seconds (0.03 Hz). More preferably, the injection rate is sampled at a rate of at least one measurement every second (1 Hz).

Preferably, the bottom hole pressure responses, the wellhead pressure responses and the injection rate are collected at the same point in time by clock synchronisation of the bottom hole pressure gauge, the wellhead pressure gauge and the flow rate meter. This improves the quality of the comparison for the calculation of friction loss.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined. This is known in the art of horizontal wells and in particular for shale formations.

Embodiments of the present invention will now be described, by way of example only, with reference to the accompanying Figures, of which:

Figure 1:
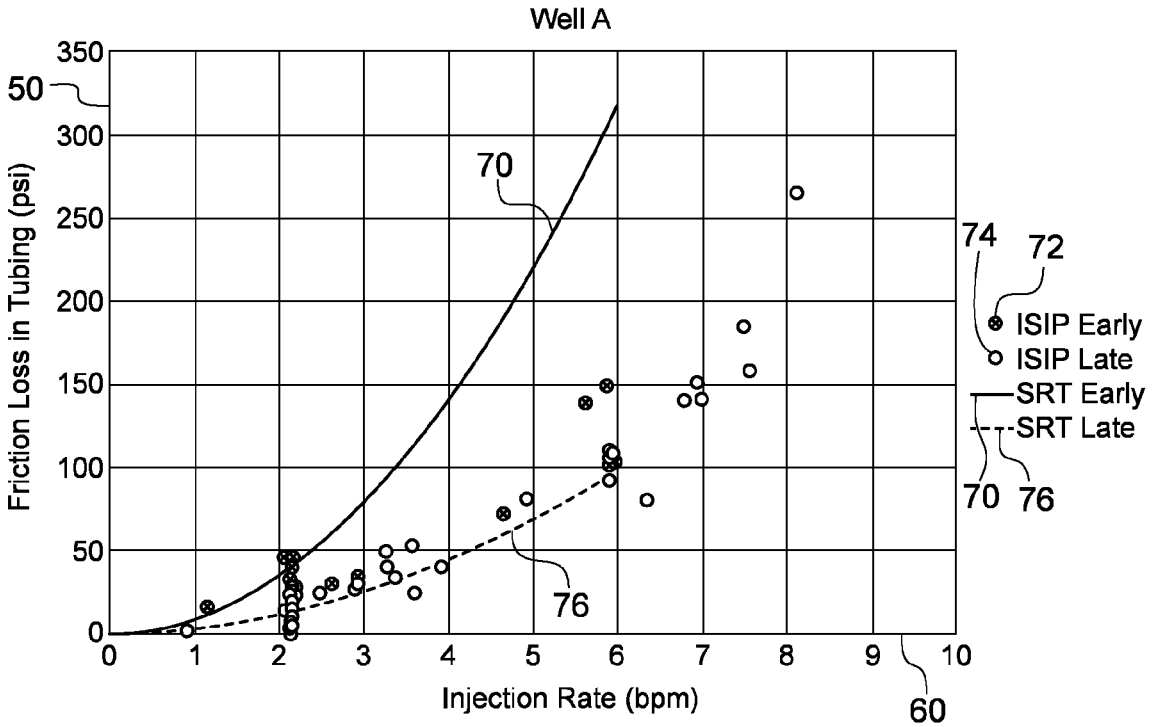
FIG. 1 is a graph of friction loss in tubing versus injection rate for illustrating condition monitoring in tubing, according to an embodiment of the present invention.

Reference is initially made to FIG. 1 of the drawings which illustrates an injection well 12 containing tubing 10 on which it is desired to perform condition monitoring by a method according to an embodiment of the present invention.

Injection well 12 is drilled in the traditional manner providing a casing 14 to support the borehole 16 through a majority of cap rock 18 to the location of the formation 20. The casing 14 is cemented in place between the casing 14 and the borehole wall 22. The borehole 16 is continued into the formation 20 with the borehole wall 22 at the sand face 23 now accessible via a slotted or perforated liner 24 which is supported from a liner hanger 26 at the bottom of the casing 14. Shallow tubing 10 is run into the casing 14 with a production packer 28 providing a seal between the tubing 10 and the casing 14, preventing the passage of fluids through the annulus 30 there-between.

At surface 32, there is a standard wellhead 34. Wellhead 34 provides a conduit 36 for the entry or exit of fluid from the well 12 which may be via a pump 38. Wellhead gauges are located on the wellhead 34 being typically a temperature gauge combined with a pressure gauge 40 and a rate gauge or flowmeter 44.

A downhole pressure gauge 42 as is known in the industry is run from a data acquisition unit 46 at surface 32, to above the production packer 28. The downhole pressure gauge 42 typically combines a downhole temperature and pressure gauge. The gauge 42 is mounted in a side pocket mandrel in the tubing 10. Data is transferred via a high capacity cable (not shown) located in the annulus 30. The gauge 14 may be a standard gauge though, for the present invention, the gauge 14 must be able to record downhole pressure data at a high acquisition rate. A quartz gauge can achieve this. The signal is recorded as an analogue signal and a port provides an analogue to digital converter set at the desired acquisition rate. This acquisition rate can be considered as a sampling frequency. The sampling frequency can be set before the gauge 42 and port are installed in the well 12 or a control signal can be sent from the unit 46 to the port via the cable, to change the sampling frequency. The unit 46 also provides clock synchronisation to sample the pressure/temperature response at each pressure gauge 40,42 together along with the flowmeter 44.

For the present invention, the sampling frequency of the gauges 40,42 is greater than 0.1 Hz and more preferably greater than 1 Hz. A measurement every ten seconds may be sufficient but more ideally a measurement every second is recorded by the gauges 40,42. The flowmeter is sampled at a rate of at least one measurement every 30 seconds (0.03 Hz) and at best once every second (1 Hz) to match the gauges 40,42. At surface 32, the data is transferred to the data acquisition unit 46. The unit 46 can control multiple gauges used on the well 12. The unit 46 can also be used to coordinate when pressure traces are recorded on the gauges 40,42 to coincide with an injection operation by, for example, having control of pumps 38 or by detecting a change in rate at the flowmeter 44. Unit 46 will include a processor and a memory storage facility. Unit 46 will also have a transmitter and receiver so that control signals can be sent to the unit 46 from a remote-control unit. Thus, the data can be analysed remotely.

Figure 2:
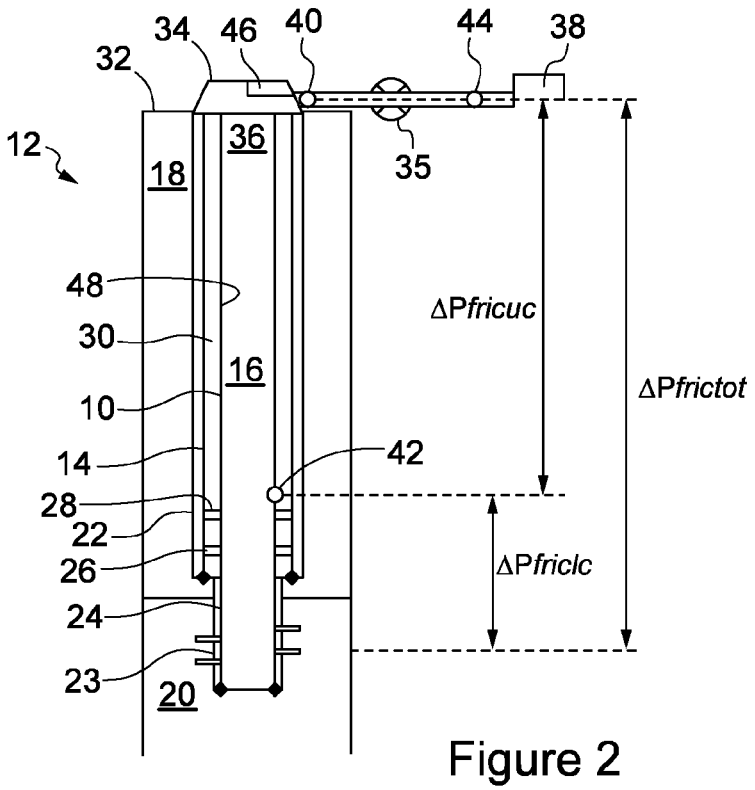
FIG. 2 is a schematic illustration of a well in which the method of the present invention is to be performed.

As can be seen in FIG. 2, the inner surface 48 of tubing 10 will be exposed fluids entering and possibly exiting the well 12. On installation the surface 48 may have residue of 'pipe-dope' the compound used in making up connections in the tubing 10. During operation, particulates and chemicals within the fluid are exposed to increases of pressure and temperature in the well and can cause deposits on the surface 48. This may be detectable as scale. Additionally, the surface 48 will be susceptible to corrosion which can cause roughening, pitting and a loss of material. This all has a deleterious effect on the condition of the tubing.

Figure 3:
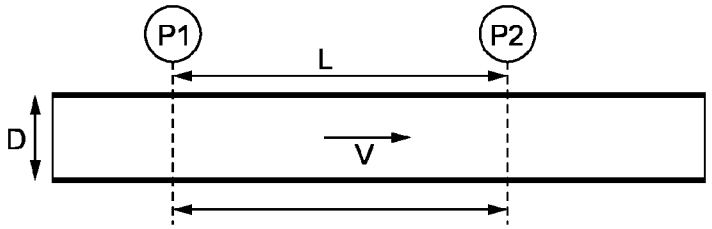
FIG. 3 is a schematic illustration of a pipe demonstrating the principle of the measurement of friction loss.

The condition of the tubing and in particular its roughness provides a friction loss through the tubing. This is governed by the Darcy-Weisbach equation which relates pressure loss, due to friction along a given length of pipe to the average velocity of the fluid flow for an incompressible fluid. Referring to FIG. 3, pressures P1 and P2 over a length L of tubing of diameter D with fluid at a velocity v and fluid density ρ, travelling therethrough gives a measurable friction loss, ΔPfric=P1−P2. ΔPfric is given by the Darcy-Weisbach law:

$$\Delta Pfric/L=fD\rho v2/(2D)$$

Where the friction coefficient fD is a function of the pipe roughness (r), the fluid viscosity (μ) etc with fD=F (r, μ, etc).

Figure 4:
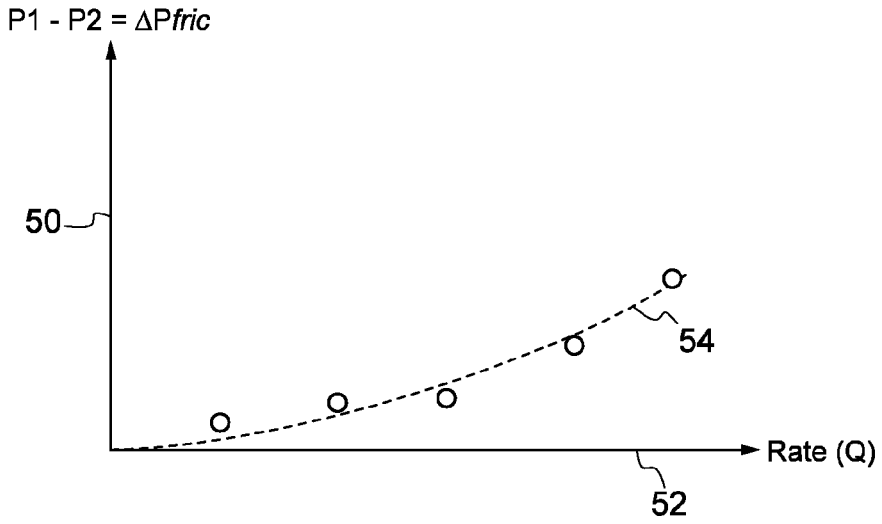
FIG. 4 is an illustrative graph of friction loss versus rate of fluid flow through a pipe.

In the laboratory, the friction loss ΔPfric can be measured as the pressure difference between two pressure gauges at various values of flow rate Q. A typical relationship is illustrated in FIG. 4 which shows a graph 54 of friction loss 50 versus flow rate 52. This shows a typical empirical relationship between friction loss, ΔPfric=P1−P2, and flow rate Q is a second order polynomial with a zero intercept at zero flow rate. Thus, while the friction loss law can be modelled and measured in laboratory conditions, in a well the pipe roughness can vary by orders of magnitude and consequently is a very large unknown value.

Returning to FIG. 2, we can consider friction losses for a typical water injector well 12. ΔPfrictot is the total friction loss between the wellhead 34 and the sand face 23. ΔPfrictlc is the total friction loss in the lower completion i.e. between the downhole pressure gauge 42 and the sand face 23. ΔPfrictuc is the total friction loss between the wellhead 34 and the downhole pressure gauge 42. This can be considered as the friction loss in the tubing 10, ΔPfric, as the downhole pressure gauge 42 is usually situated close to the bottom end of the tubing 10. As previously taught, hydrostatic pressure exists in a vertical well and this requires to be corrected for in any calculations.

A step rate test is known in the art for determining formation fracture pressure of a given formation at an injection well. In this the friction losses are estimated, and a bottom hole pressure is derived which will provide sufficient pressure to create fractures in the formation but not cause fracturing to extend over permitted regulatory guidelines. In the present invention, the applicants have realised that the step rate test can be used to measure friction loss in the tubing.

Figure 5:
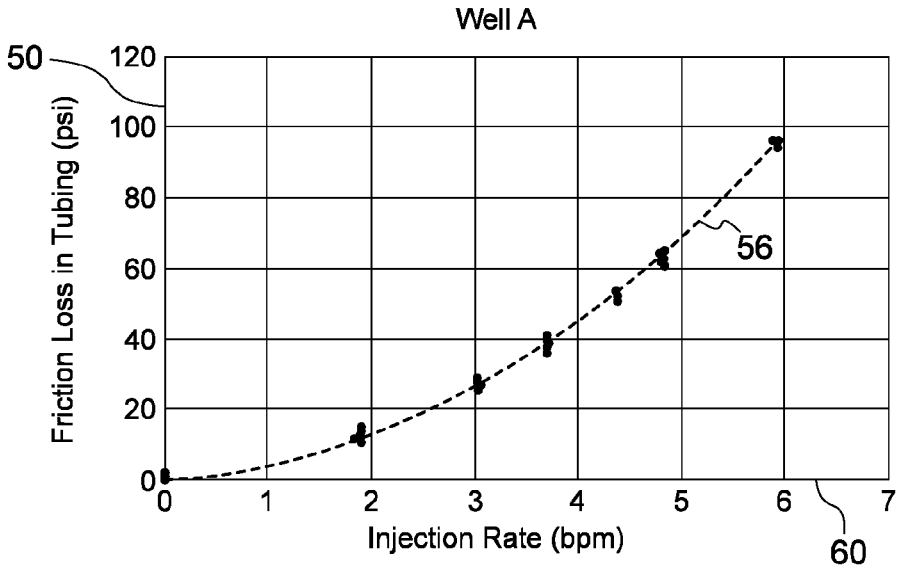
FIG. 5 is a graph of friction loss in tubing versus injection rate from a step rate test performed on the well of FIG. 2.

In a well 12, the injection rate can be varied by the rate of the pumps 38 and measured at the flowmeter 44 to provide an equivalent flow rate. At the downhole pressure gauge 42, a pressure response is continuously measured and thus bottom hole pressure (BHP) can be measured for each injection rate. Concurrently, at the wellhead pressure gauge 44, a pressure response is continuously measured and thus a wellhead pressure (WHP) can be measured for each injection rate also. From FIG. 2, the friction loss in the tubing 10, ΔPfric, can be calculated from BHP minus WHP, with the values being corrected for fluid density and the corresponding hydrostatic column. The results of a step rate test on a well are shown in FIG. 5. Friction loss 50 in the tubing (psi) is plotted against injection rate 60 (bpm) with a $2^{nd}$ order polynomial 56 fitted to the data to obtain the characteristic curve.

While a step rate test could be performed at periodic time intervals on the well and the data plotted for comparison to see any increases in friction loss which could indicate deterioration of the tubing 10, this is not ideal. This is because step rate tests are not routinely performed on a well. To perform a step rate test, you would need to intervene in the standard operation of the well and during the step rate test the well would not be used at its optimal capacity. Consequently, this means there is an associated cost in performing a step rate test.

Figure 6:
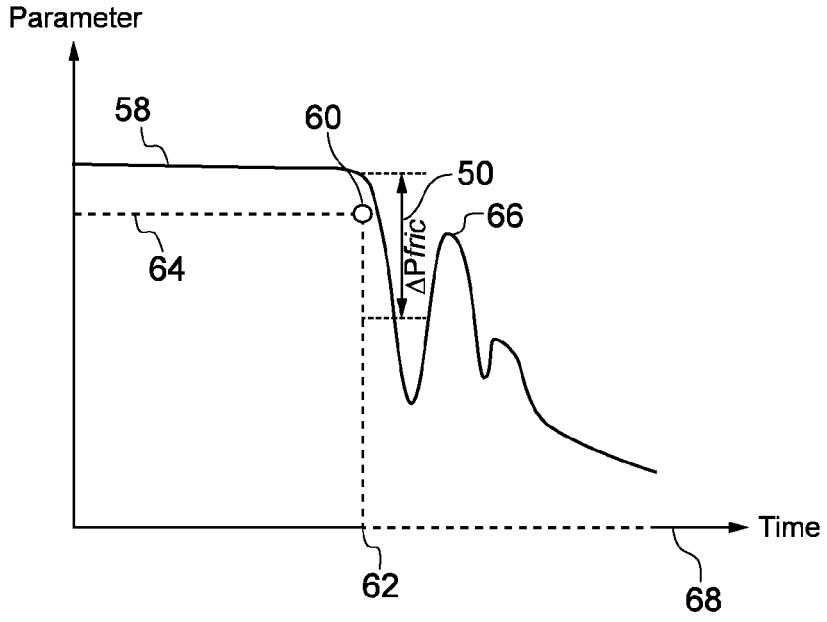
FIG. 6 is a graph of pressure versus time illustrating a pressure response measure at shut-in on the well of FIG. 2.

The present invention therefore presents a method of condition monitoring in which the friction loss can be measured at shut-in. At shut-in a pressure change is induced in the well 12 when the pumps 38 are switched off or a valve 35 in the conduit 36 is closed. The downhole pressure gauge 42 and wellhead pressure gauge 40 will record a change in pressure. At shut-in the pressure gauges 40,42 are continuously recording and the port is preferably set to a high sampling frequency i.e. 0.1-Hz or greater. If the shut-in is done quickly, the graph of pressure against time i.e. the pressure response will show a water hammer pressure wave with peaks and troughs illustrating the reflections of the water hammer pressure wave from stiff reflectors in the formation 20. If the shut-in is slow then the hammer wave will be too truncated for analysis. The injection rate will be the last recorded flow rate measured at the flowmeter 44 at shut-in. FIG. 6 illustrates a standard pressure response 58 at shut-in 62. The injection rate curve 64 is seen to be constant and drop to zero at the shut-in point 62 in time 68. The pressure response 58 is seen to go from a constant value to a water hammer pressure wave 66. Using instantaneous shut-in pressure (ISIP) analysis, the pressure response at the wellhead gauge 40 will give the total friction loss, ΔPfrictot, while analysis of the ISIP at the downhole pressure gauge 42 will give the friction loss in the lower completion, ΔPfriclc. Consequently, ΔPfrictot−Δpfriclc=ΔPfric, the friction loss in the tubing 10 at a given injection rate Q. The most accurate measurements will be given if the gauges 40,42 are time synchronised.

As shut-ins, either voluntary or accidental, occur more frequently than stoppages for step rate tests, then data can be collected with more frequency and without an associated cost as the gauges are always making measurements. Thus, an interventionless measurement of friction loss can be made.

In a preferred embodiment the method includes performing a step rate test with newly installed tubing to create a baseline measurement of friction loss. Then upon each shut-in instantaneous shut-in pressure (ISIP) analysis is performed on the wellhead and bottom hole pressure responses to provide a ΔPfric value for friction loss in the tubing at the measured injection rate at shut-in on the flowmeter 44. The ΔPfric value can be compared to the baseline measurement. If the friction loss appears to be increasing intervention in the form of logging such as with a multi finger caliper can be used to measure more exactly the deterioration of the inner surface 48 of the tubing 10. Decisions can then be taken on whether the tubing 10 should be replaced. The changed friction loss measurement can also be used to better predict injection parameters to ensure fracture pressure is reached if this is required.

Figure 7:
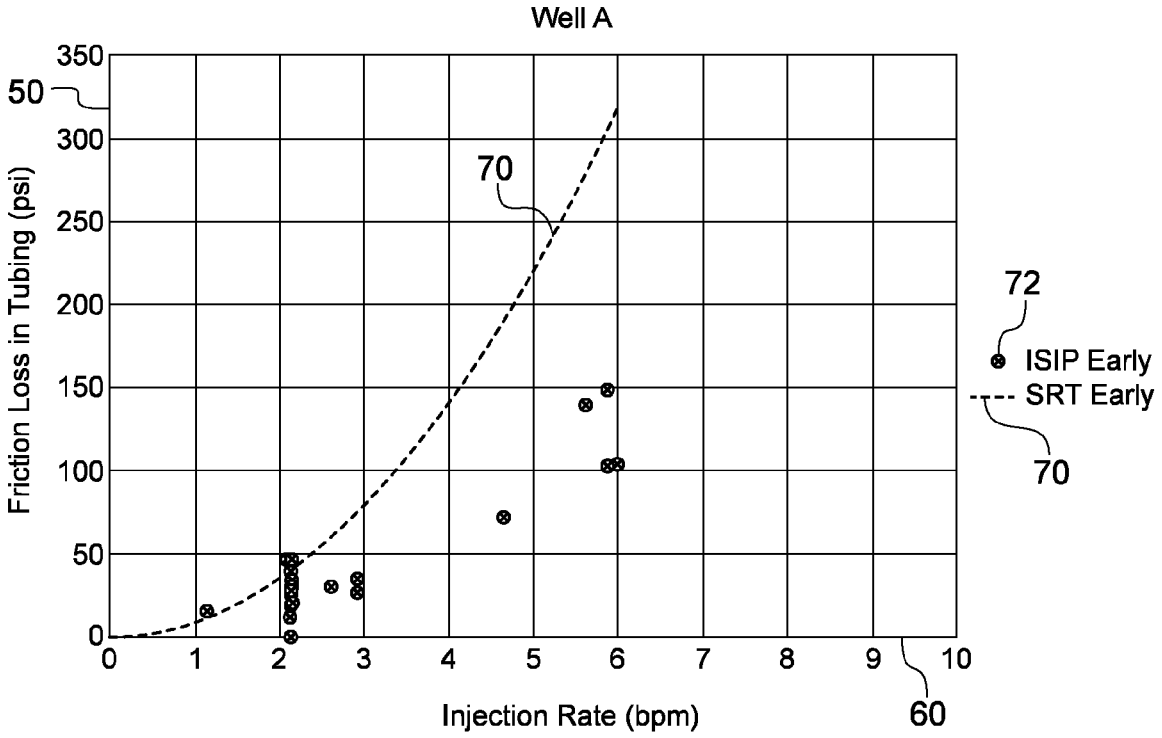
FIG. 7 is a graph of friction loss in tubing versus injection rate for friction loss from a step rate test and friction loss from multiple early shut-ins.

FIG. 7 illustrates friction loss 50 versus injection rate 60 on a well 12 according to an embodiment of the present invention. In this case, an initial step rate test was performed when the tubing was newly installed. This provides the baseline measurement curve 70. A number of shut-ins occurred when injecting the first 25,000 bbl of water into the well 12. On each shut-in a combined ISIP analysis was carried out on the BHP response and the WHP response to provide the friction loss in the tubing at the last recorded injection rate prior to shut-in. These are plotted as individual points 72. This Figure shows a very quick decrease in the friction loss in the tubing as the points 72 move below the initial baseline measurement curve 70. This indicates that on first injecting water into the well the tubing 10 has been cleaned and thus the friction loss improved. It is assumed that 'pipe-dope' used to make up the connections in the tubing 10 will have been left on the inner surface 48 and on initial injection of water this has been rinsed away.

Figure 8:
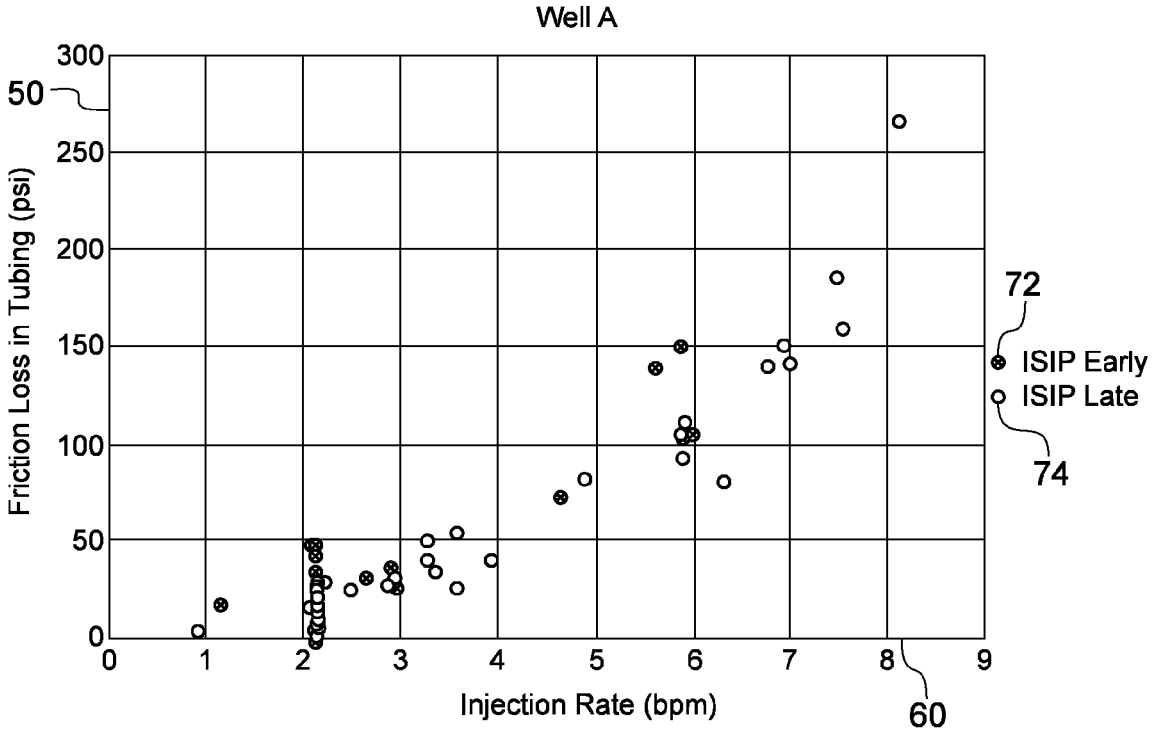
FIG. 8 is a graph of friction loss in tubing versus injection rate for early and late shut-ins.

The baseline measurements may themselves come from responses taken at earlier shut-ins by using the combined ISIP analysis. FIG. 8 illustrates this were the points 72 of FIG. 7 are now used as the baseline measurements taken from the early shut-ins. For FIG. 8 a series of shut-ins were analysed by combined ISIP analysis to give friction loss after the well injected 1.25 Mbbl. These are illustrated at points 74. If we exclude the very early shut-ins, both baseline measurements at early ISIP 72 and the later shut-ins at late ISIP 74 fall on the same trend. Thus, the comparison between baseline measurement 72 with the later measurements 74 indicates that there is no significant change in the friction loss. It can therefore be taken that there is no detectable deterioration to the condition of the tubing 10 over the time period of making measurements.

To check the validity of the late ISIP measurements 74, a further step rate test (SRT) was performed at the late life of the well. FIG. 1 shows all the measurements combined on a single plot of friction loss 50 in the tubing 10 versus injection rate 60. Like parts to those in earlier Figures have been given the same reference numeral to aid clarity. It is seen in FIG. 1 that the late SRT 76 is a curve which closely matches the late combined ISIP analyses 74. This verifies the use of instantaneous shut-in pressure analysis as a means of measuring friction loss in an injection well. It also demonstrates its use in condition monitoring of tubing. Here the tubing is considered in excellent condition and has not changed since its initial cleaning i.e. no detectable deposit, corrosion, scaling etc.

The principle advantage of the present invention is that it provides a method of condition monitoring of tubing in an injection well which does not require intervention as the data can be automatically collected at each shut-in.

A further advantage of the present invention is that it provides a method of condition monitoring of tubing in an injection well which uses equipment already present at and in the well.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, while the well is described and shown as vertical the invention can be used in wells of any deviation.

The invention claimed is:

1. A method of condition monitoring of tubing in an injection well, comprising the steps:

(a) measuring a first bottom hole pressure response downhole at a bottom hole location in the well and a first wellhead pressure response at a wellhead of the well for a plurality of base injection rates of fluid in the well;

(b) determining a friction loss in the tubing between the bottom hole location and the wellhead from the first wellhead pressure response and the first bottom hole pressure response at each of the base injection rates to provide a baseline measurement of friction loss in the tubing against the base injection rates;

(c) after a first time period;

(d) measuring a second bottom hole pressure response and a second wellhead pressure response for a monitored injection rate of fluid in the well;

(e) determining a friction loss in the tubing between the bottom hole location and the wellhead from the second wellhead pressure response and the second bottom hole pressure response at the monitored injection rate to provide a monitored measurement of friction loss in the tubing at the monitored injection rate;

(f) analysing the monitored measurement by making a comparison with the baseline measurement to determine any change in friction loss over the first time period;

(g) using an increase in friction loss over the first time period as an indicator of deterioration in the condition of the tubing;

the method being characterised in that:

the second bottom hole pressure response and the second wellhead pressure response are measured at a shut-in of the well.

2. A method of condition monitoring of tubing in an injection well according to claim 1 wherein steps (d) to (g) are repeated for at least two shut-ins.

3. A method of condition monitoring of tubing in an injection well according to claim 1 wherein steps (d) to (g) are repeated for every shut-in.

4. A method of condition monitoring of tubing in an injection well according to claim 1 wherein the monitored injection rate is determined from a last injection rate before shut-in.

5. A method of condition monitoring of tubing in an injection well according to claim 1 wherein the baseline measurement of friction loss is determined over a range of injection rates by performing steps (a) and (b) as part of a step rate test.

6. A method of condition monitoring of tubing in an injection well according to claim 1 wherein the measurement of friction loss in steps (d) and (e) is part of an Instantaneous Shut-In Pressure (ISIP) analysis.

7. A method of condition monitoring of tubing in an injection well according to claim 6 wherein the ISIP is analysed for the second bottom hole pressure response and the second wellhead pressure response.

8. A method of condition monitoring of tubing in an injection well according to claim 1 wherein the baseline measurement of friction loss is determined over a range of injection rates by performing steps (a) and (b) as a series of shut-ins by analysing the ISIP.

9. A method of condition monitoring of tubing in an injection well according to claim 1 wherein the baseline measurement of friction loss is performed with newly installed tubing.

10. A method of condition monitoring of tubing in an injection well according to claim 1 wherein the shut-in is voluntary.

11. A method of condition monitoring of tubing in an injection well according to claim 1 wherein the shut-in is accidental.

12. A method of condition monitoring of tubing in an injection well according to claim 1 wherein the calculation of friction loss using the bottom hole pressure response and the wellhead pressure response is corrected for hydrostatic pressure at each depth in the well.

13. A method of condition monitoring of tubing in an injection well according to claim 1 wherein the method includes the additional steps of running a tubing log in the event that a deterioration in the condition of the tubing is determined.

* * * * *